US012618589B2

(12) United States Patent
Nagi

(10) Patent No.: US 12,618,589 B2
(45) Date of Patent: May 5, 2026

(54) ELECTRIC BOILER

(71) Applicant: Jaskiran Singh Nagi, Windsor (GB)

(72) Inventor: Jaskiran Singh Nagi, Windsor (GB)

( * ) Notice: Subject to any disclaimer, the term of this patent is extended or adjusted under 35 U.S.C. 154(b) by 844 days.

(21) Appl. No.: 17/794,752

(22) PCT Filed: Feb. 10, 2021

(86) PCT No.: PCT/GB2021/050308
§ 371 (c)(1),
(2) Date: Jul. 22, 2022

(87) PCT Pub. No.: WO2021/161015
PCT Pub. Date: Aug. 19, 2021

(65) Prior Publication Data

US 2023/0112867 A1 Apr. 13, 2023

(30) Foreign Application Priority Data

Feb. 12, 2020 (GB) ..... 2001908

(51) Int. Cl.
*F24H 1/14* (2022.01)
*F24D 19/00* (2006.01)
(Continued)

(52) U.S. Cl.
CPC ..... *F24H 1/142* (2013.01); *F24D 19/0092* (2013.01); *F24H 1/225* (2013.01); *F24H 9/0021* (2013.01); *F24H 9/2014* (2013.01)

(58) Field of Classification Search
None
See application file for complete search history.

(56) References Cited

U.S. PATENT DOCUMENTS 1,519,395 A * 12/1924 Clench ..... F24H 1/102 392/480
1,767,122 A * 6/1930 Dean ..... F24H 1/142 392/483
(Continued)

FOREIGN PATENT DOCUMENTS

CN 102410620 A 4/2012
CN 102563845 A 7/2012
(Continued)

OTHER PUBLICATIONS

Office Action for United Kingdom Patent Application No. 2001908.9, mailed Jul. 21, 2020, 4 pages.
(Continued)

*Primary Examiner* — Thor S Campbell
(74) *Attorney, Agent, or Firm* — Withrow + Terranova, PLLC; Vincent K. Gustafson

(57) ABSTRACT

The present invention provides an electric boiler having a heating element surrounded by a thermally conductive inner container to define an inner passage about the heating element, the inner container having an inlet and an outlet for a flow of water and is arranged such as to cause water received at the inner container inlet to flow along the inner passage in close proximity to a surface of the heating element, the boiler further comprising an outer container in which the inner container is substantially located, the outer container defining an outer passage about at least part of the inner container, the outer container having an outlet into the inner container wherein the outer container is arranged such as to cause water to flow along the outer passage in close proximity to a surface of the inner container, such that water received in the boiler makes at least a double pass through the boiler to increase the potential heat transfer to the water.

13 Claims, 13 Drawing Sheets

(51) Int. Cl.

| | |
|---|---|
| ***F24H 1/22*** | (2022.01) |
| ***F24H 9/00*** | (2022.01) |
| ***F24H 9/20*** | (2022.01) |

(56) References Cited

U.S. PATENT DOCUMENTS

| | | | | | |
|---|---|---|---|---|---|
| 1,963,367 | A * | 6/1934 | Ingison | F24H 1/202 | 392/377 |
| 1,985,830 | A * | 12/1934 | Hynes | F24H 1/102 | 392/471 |
| 2,589,566 | A * | 3/1952 | Neth | F24D 3/00 | 122/13.3 |
| 2,698,739 | A * | 1/1955 | Haugen | F24D 3/10 | 237/66 |
| 2,775,683 | A * | 12/1956 | Kleist | F28D 7/106 | 392/397 |
| 2,797,297 | A * | 6/1957 | Nihlen | F24H 3/081 | 165/185 |
| 3,096,426 | A * | 7/1963 | Axelson | F24H 1/121 | 392/494 |
| 3,109,912 | A * | 11/1963 | Cerulli | F24H 3/0405 | 219/544 |
| 3,350,915 | A * | 11/1967 | Staffin | G01K 15/005 | 374/3 |
| 4,185,187 | A * | 1/1980 | Rogers | F24H 15/37 | 392/471 |
| 4,242,569 | A * | 12/1980 | Kayser | F24D 17/001 | 126/362.1 |
| 4,286,140 | A * | 8/1981 | Dewulf | F24H 15/174 | 392/487 |
| 4,514,617 | A * | 4/1985 | Amit | F24H 1/202 | 122/18.4 |
| 4,563,571 | A * | 1/1986 | Koga | F24H 1/102 | 392/503 |
| 4,587,401 | A * | 5/1986 | Ekman | F24H 1/20 | 126/362.1 |
| 5,400,432 | A * | 3/1995 | Kager | H05B 3/42 | 392/492 |
| 5,559,924 | A * | 9/1996 | Kadotani | F24H 1/142 | 392/483 |
| 6,157,778 | A * | 12/2000 | Kadotani | F24H 1/142 | 392/483 |
| 6,289,177 | B1 * | 9/2001 | Finger | H05B 3/06 | 392/455 |
| 7,248,792 | B2 * | 7/2007 | Mihara | F24H 1/162 | 392/492 |
| 7,668,444 | B2 * | 2/2010 | Tsai | H05B 3/44 | 392/407 |
| 7,756,404 | B2 * | 7/2010 | Schubert | F28D 7/026 | 392/484 |
| 8,731,386 | B2 * | 5/2014 | Waechter | H05B 3/42 | 392/491 |
| 8,855,475 | B2 * | 10/2014 | King | F24H 1/121 | 392/452 |
| 9,014,548 | B2 * | 4/2015 | Jang | F24H 1/121 | 392/491 |
| 9,867,232 | B2 * | 1/2018 | Mann | H05B 3/48 | |
| 2003/0164402 | A1 * | 9/2003 | Doclo | F24H 1/225 | 237/70 |
| 2017/0268799 | A1 * | 9/2017 | Fu | F24H 9/2028 | |
| 2019/0285313 | A1 * | 9/2019 | Nelson | H05B 3/24 | |

FOREIGN PATENT DOCUMENTS

| | | | |
|---|---|---|---|
| CN | 109556278 | A | 4/2019 |
| DE | 102011106659 | A1 | 1/2013 |
| EP | 3273175 | A1 | 1/2018 |
| GB | 564644 | A | 10/1944 |
| GB | 2548392 | A | 9/2017 |
| KR | 950029700 | A | 11/1995 |
| KR | 100833692 | B1 | 5/2008 |
| WO | 2009050631 | A1 | 4/2009 |

OTHER PUBLICATIONS

Office Action for United Kingdom Patent Application No. 2014928.2, mailed Oct. 12, 2020, 4 pages.

International Search Report and Written Opinion for International Patent Application No. PCT/GB2021/050308, mailed May 10, 2021, 12 pages.

Office Action for Chinese Patent Application No. 2021800142655 mailed Dec. 3, 2025, 19 pages.

Office Action for European Patent Application No. 21706669.5 mailed Dec. 10, 2024, 5 pages.

Office Action for Canadian Patent Application No. 3165434 mailed Oct. 5, 2023, 6 pages.

* cited by examiner

ELECTRIC BOILER

This application is a 35 U.S.C. § 371 national phase filing of International Application No. PCT/GB2021/050308, filed on Feb. 10, 2021, and claims the benefit of United Kingdom Patent Application No. 2014928.2 filed on Sep. 22, 2020 and United Kingdom Patent Application No. 2001908.9 filed on Febraury 12, 2020, wherein the entire contents of the foregoing applications are hereby incorporated by reference herein.

The present invention relates to an electric boiler and particularly, but not exclusively, to an electric boiler suitable for heating sanitary water in a domestic or commercial premises, or suitable for use in a central heating system.

Generally, electric boilers have in the past tended to be predominantly used for single point of supply applications, for example electric showers, hot water supplies for single (or local) wash hand basins or similar, where it is not desired to install a traditional central emersion heater or fossil fuel boiler. This could be to avoid the expense and possible disruption associated with installing larger heating systems, or where there is a desire to ensure a reliable instantaneous supply of hot water. However, more recently electric boilers are also being used more commonly in place of the more traditional fossil fuel boiler, where they centrally provide hot water to a number of sanitary outlets and/or form the boiler of a central heating system. These new applications for electric boilers require far more powerful boilers than those traditionally used in the examples mentioned above.

It is an object of the present invention to provide a particularly compact arrangement of electric boiler which is capable of providing an instantaneous hot water supply, suitable for a sanitary hot water supply or for a central heating system.

According to the present invention there is provided an electric boiler comprising a heating element and a thermally conductive inner container, the inner container substantially surrounding the heating element to define an inner passage about the heating element, the inner container having an inlet and an outlet for a flow of water and being arranged such as to cause water received at the inner container inlet to flow along the inner passage in close proximity to a surface of the heating element to the inner container outlet, the boiler further comprising an outer container in which the inner container is substantially located, the outer container defining an outer passage about at least part of the inner container, the outer container having an inlet and an outlet for a flow of water, wherein the outer container outlet is fluidly connected to, or forms, the inner container inlet and wherein the outer container is arranged such as to cause water received at the outer container inlet to flow along the outer passage, in close proximity to a surface of the inner container, to the outer container outlet.

By having an inner container substantially surrounding the heating element, the inner container can be arranged to concentrate the flow of water over the surface of the heating element, providing only a small clearance between a surface of the container and a surface of the heating element and thus a low volume space through which water is forced to flow at high flow rates, providing a high heating surface area to volume ratio. The advantage of such an arrangement is that there is very little inertia within the boiler, due to the relatively low volume of water stored within the boiler and thus the boiler may function as an instantaneous hot water heater, at least at the point where the water leaves the boiler. This not only has the benefit of being able to quickly provide a source of hot water, without the need to have a cylinder of preheated hot water, but it may also minimise the residual energy stored within the boiler after hot water has been drawn from the boiler.

The provision of an outer container, in which the inner container is substantially located, enables water being drawn into an inlet of the boiler to be preheated, by first passing through the outer container and absorbing heat from the inner container, particularly if the inner container and outer container share a common thermally conductive wall, before being drawn through the inner container where it comes into contact with the heating elements. A boiler in accordance with the present invention can thus be used to increase the area of heated surface a relatively small volume of water comes into contact with, which may enable significantly more energy to be extracted from the heating elements without causing the water to boil at any point.

Preferably, the inner and outer passages are arranged such that in use water in the first inner passage progresses along the first passage in a direction opposite to the direction in which the water progresses along the second passage.

The above arrangement may provide a particularly compact arrangement of boiler that is relatively inexpensive to construct, but it can also be arranged to cause the coldest water, that entering the outer chamber, to come into contact with the hottest portion of the inner container, thus maximising heat transfer from the water in the inner container to the water in the outer container.

In one embodiment, the boiler may comprise a plurality of heating elements located in the common inner container. In this manner, the heating elements may be arranged in a compact arrangement while permitting the water within the inner container to freely flow between them. This also permits a number of standard heating elements to be employed, for example a number of standard, off the shelf, two kilowatt cartridge heating elements could be used as the heating elements.

In an alternative arrangement, the boiler may comprise a plurality of elongate heating elements and a plurality of tubular inner containers, each heating element being arranged concentrically within an associated inner container. In this manner, each of a plurality of heating elements has its own inner container forcing water entering that inner container to flow over the surface of the associated heating element. This maximises the volume of water that comes into contact with the surface area of the heating elements, by avoiding any "backwaters" that may otherwise occur. With this arrangement it may be preferable for the boiler to comprise a single outer container in which the plurality of inner containers are arranged, together with their associated heating elements.

The plurality of inner containers may be arranged side by side in a cylindrical pattern and connected to each other to define a central passage within the boiler, whereby the inner containers are aligned with a longitudinal axis of the boiler and wherein the boiler is arranged such that water enters through the outer container at or towards a first end of the boiler and travels in a first longitudinal direction along the outer passage, to exit the outer passage through the outer container outlet at or towards a second end of the boiler opposite to the first end. The water may then enter the inner containers through respective inner container inlets located at or towards a second end of the boiler, the water then passing along the respective inner passages to exit via respective outlets of the inner containers located at or towards the first end of the boiler. From there the water may enter the central passage and pass along the central passage towards the second end of the boiler. In this manner the inner containers may form a wall of the outer container, defining the outer passage, form the inner passages and also form a third central passage, thus causing the water to flow directly over the heating elements on one pass (a second pass) and to indirectly flow over the heating elements on two additional passes (a first pass and a third pass).

The outer container of the boiler may comprise at least two end portions and a cylindrical portion extending therebetween in which the plurality of inner containers are located, wherein each heating element is secured in place in one of the two end portions. This arrangement provides a particularly compact arrangement and may only require machining of the end portions, or just one end portion, to permit the heating elements to be correctly mounted.

The outer container inlet may be arranged to direct water tangentially into the outer passage, so that it spirals around the inner container as the water progresses along the passage to the outer container outlet. This arrangement ensures that the water in the outer container circulates around the whole of the inner container, cooling all the surface area of the inner container, without the need for mounting baffles in the outer container or otherwise directing flow.

An electric boiler as described above may further comprise one or more ultrasonic transducers arranged to break up or dislodge any scale accumulating on a surface within the boiler. This may be important in applications where the boiler is used for heating sanitary water and where it will not therefore be a sealed system. Thus the system will not be able to contain inhibitors and may be subjected to a continual fresh supply of impurities, such as limescale. Internal or external filters may though be used to reduce the number of impurities entering the boiler.

In one embodiment the outer container is a first outer container, the boiler further comprising a second outer container in which the first outer container is located, wherein the first outer container and second outer container share a common thermally conductive wall, the second outer container having an inlet and an outlet and defining a second outer container passage arranged to convey water in close proximity to the common thermally conductive wall from the inlet to the outlet of the second outer container, wherein the passage of the second outer container is in fluid isolation from the passage of the first outer container and the passages of the inner container, or inner containers.

With the above described arrangement of boiler, the first outer container and the inner container define a first flow path and the heating element or elements can be used to heat water flowing along that first flow path. However, when water is not being drawn through that first flow path, the water in that first flow path may still be heated, which will heat water flowing in the second outer container, defining a second flow path separate to the first flow path. In this manner, two fluidly isolated separate water supplies, or flow paths, may be heated without the need of diverter valves or the like. The above arrangement can be used to create a combination boiler of a central heating system in accordance with a second aspect of the present invention.

In accordance with a second aspect of the invention, a central heating system comprises a boiler as described above, where sanitary water to be heated enters through a first inlet of the boiler, before being received by and passing through the passage of the first outer container and the passage of the inner container where it is heated, before exiting through a first outlet of the boiler. The boiler additionally having a second inlet, to which a return of the central heating system is connected, with water entering the second inlet passing through the passage of the second outer container to exit the boiler through a second outlet of the boiler, to be recirculated around the central heating system.

With a central heating system, as described above, the electric boiler of the invention functions as a combination boiler, with sanitary water being drawn through and heated in the first outer container and the inner container. Then, when sanitary water is not being drawn through the boiler, this water in the boiler may be heated to transfer energy to the water of the central heating system passing through the second outer container. Thus the flow of sanitary water through the boiler can be used to control the transfer of energy from the heating elements to the central heating system without the use of valves, for when sanitary water is being drawn this will absorb the heat energy from generated by the heating elements. However, when sanitary water is not being drawn that energy may then be transferred to the central heating system. The major advantage of this arrangement is that the sanitary water automatically takes precedence for the available heat energy supplied by the heating elements.

With the above described central heating system it is preferable if this further comprises: a pump for circulating water around the central heating system; a temperature sensor for detecting the temperature of water returning to the boiler through the second inlet; a flow or pressure sensor for detecting the flow of sanitary water through the boiler; and a controller arranged to control the pump at least in part in dependence on signals received from the temperature sensor and the flow or pressure sensor. The controller may then be arranged to activate the pump when it is detected that sanitary water is being drawn through the boiler and the temperature of the central heating water returning to the boiler is above a predetermined temperature and to turn off the pump when it is detected that sanitary water is being drawn and the temperature of the water returning from the central heating system to the boiler is below a predetermined temperature.

With the above arrangement the central heating pump can be turned off when sanitary water is being drawn through the boiler such that all the heat generated in the boiler passes to the sanitary water passing through the boiler. However, where the water returning from the central heating system is above a predetermined temperature, then the heat stored in the central heating system may be utilised to heat the sanitary water as it passes on its first pass through the first outer container, so that the sanitary water is then preheated by the central heating return, before it passes through the inner container of the boiler.

Two embodiments of the present invention will now be described, by way of example only, with reference to the following drawings, of which:

Figure 2:
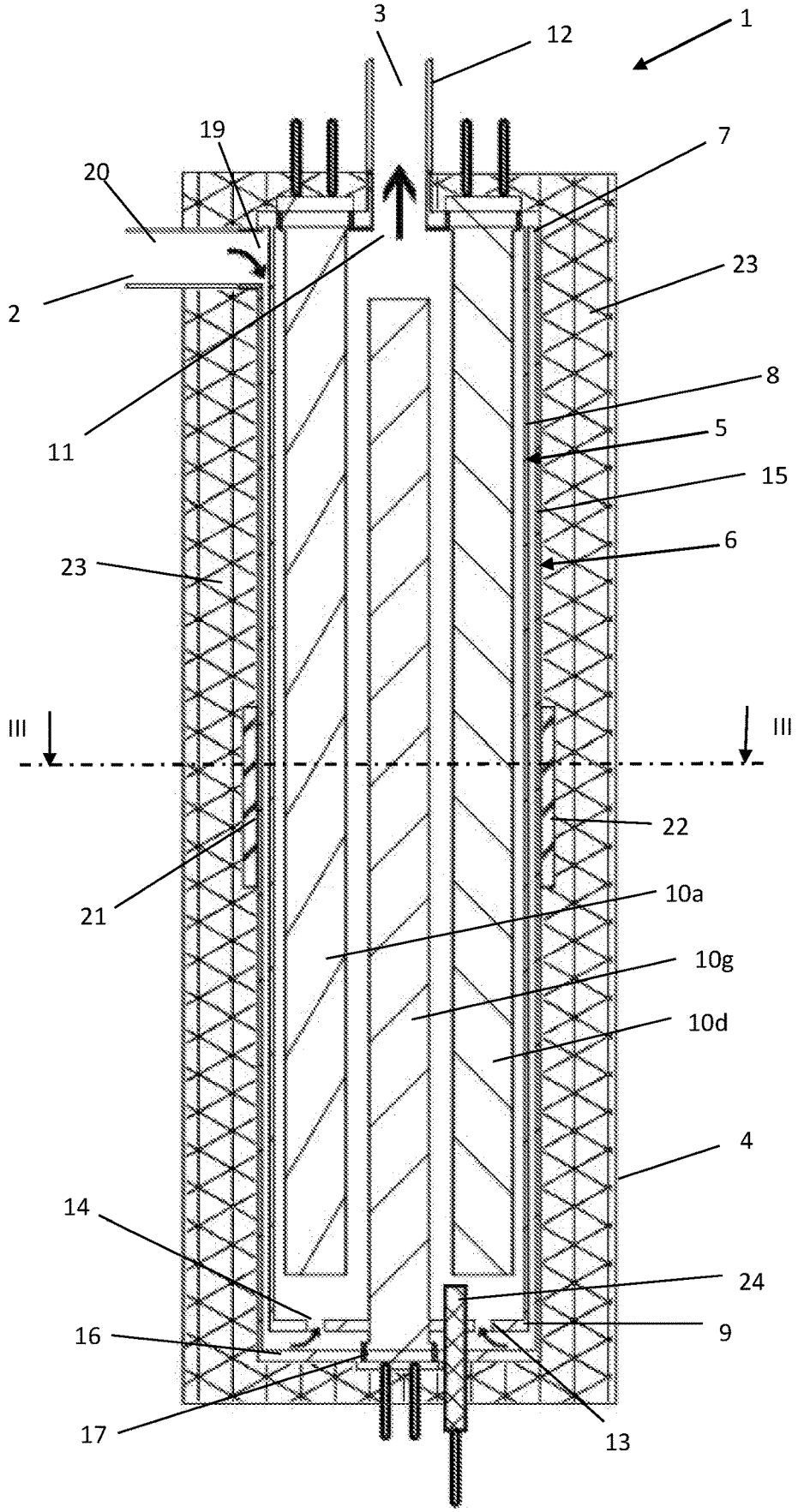
FIG. 2 is a vertical cross-section through the boiler of FIG. 1.
Figure 4:
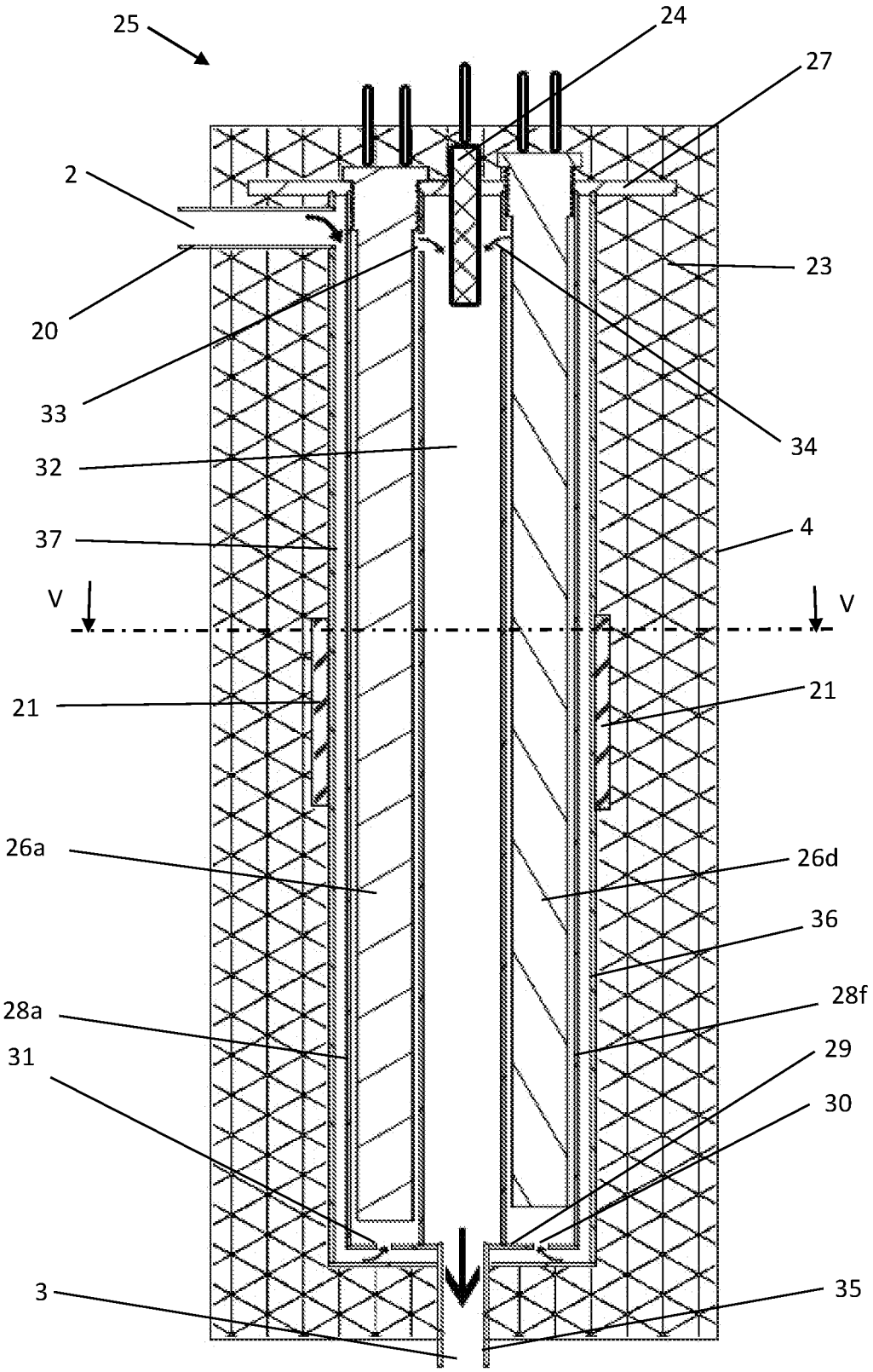
FIG. 4 is a vertical cross-section through a boiler in accordance with the present invention, similar to the boiler of FIG. 1.
Figure 6:
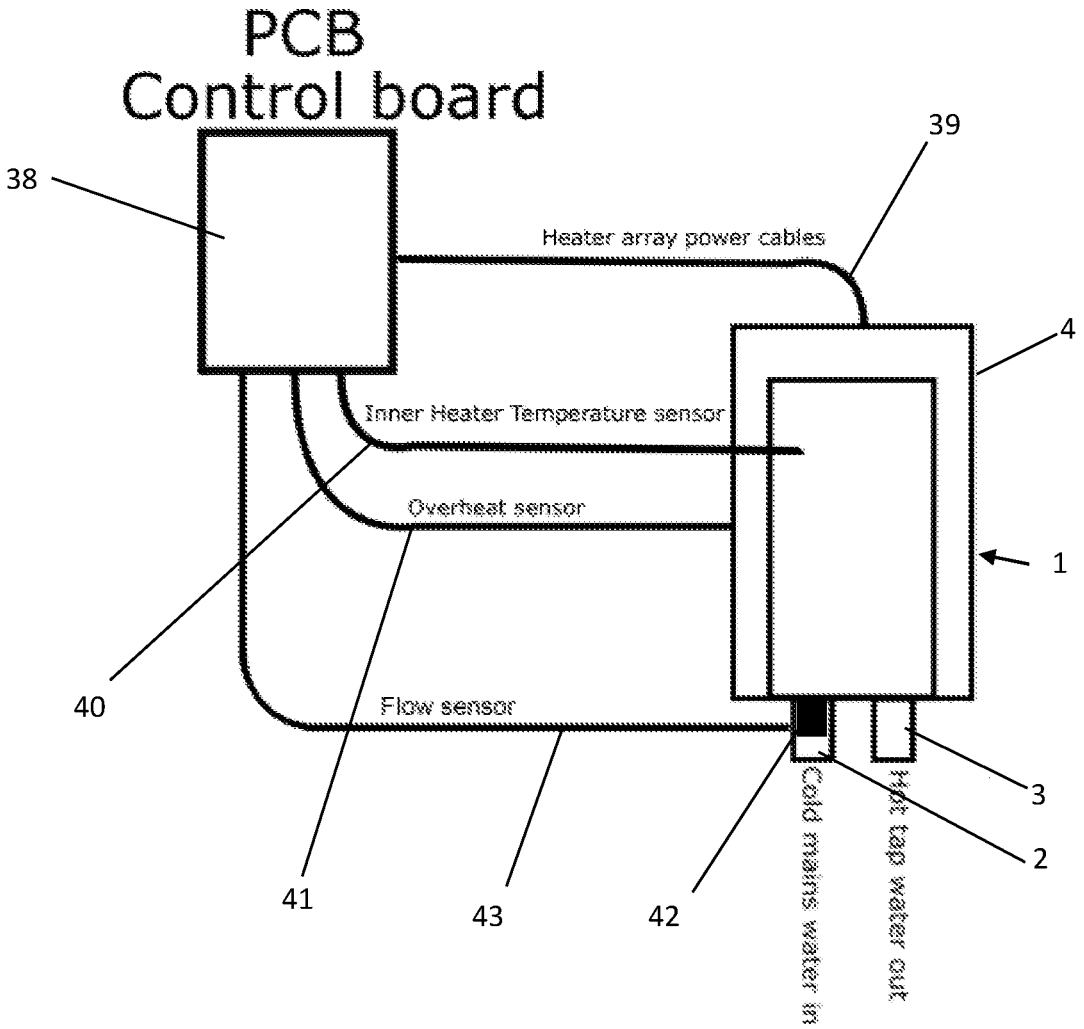
Figure 7:
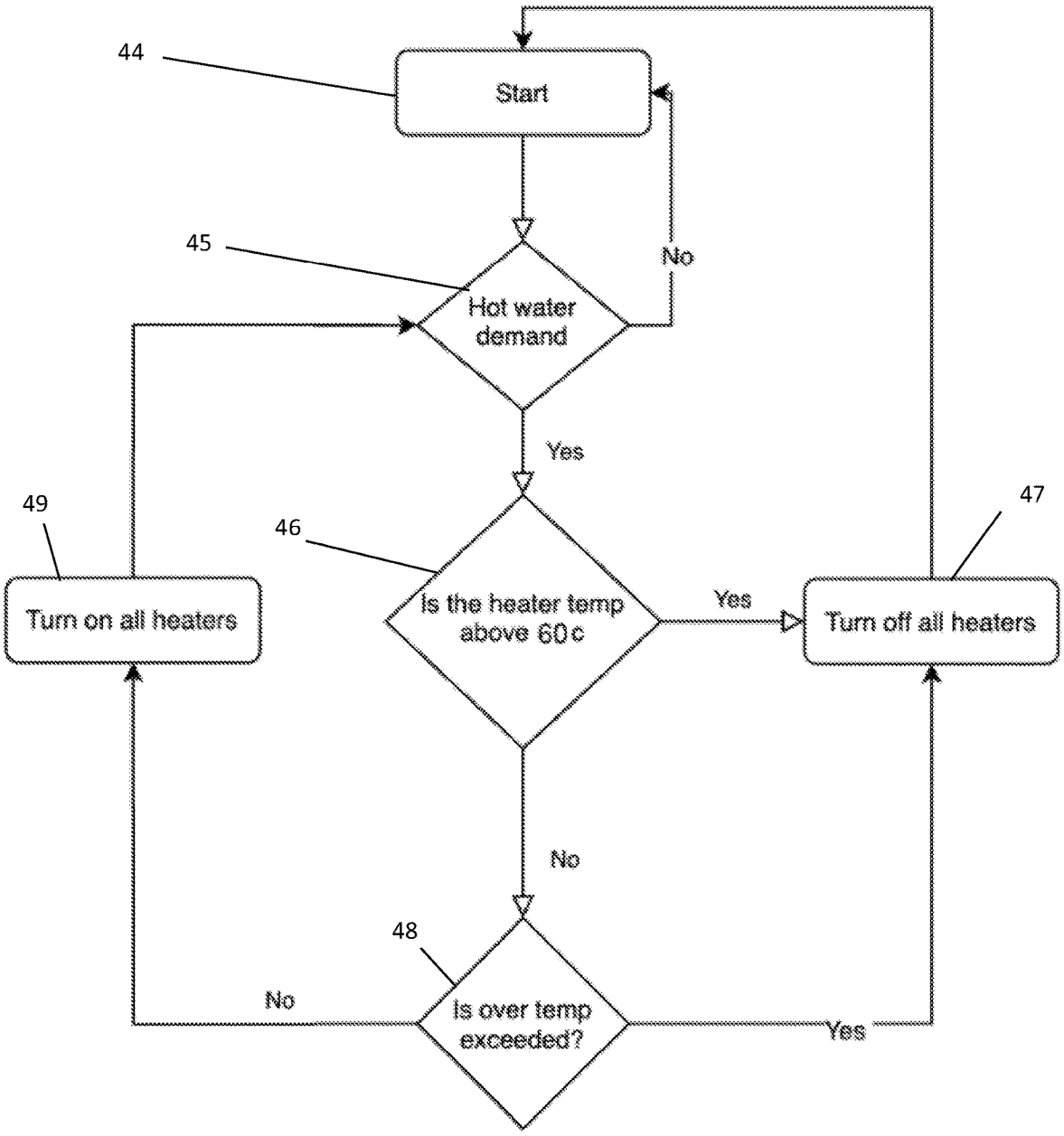
Figure 8:
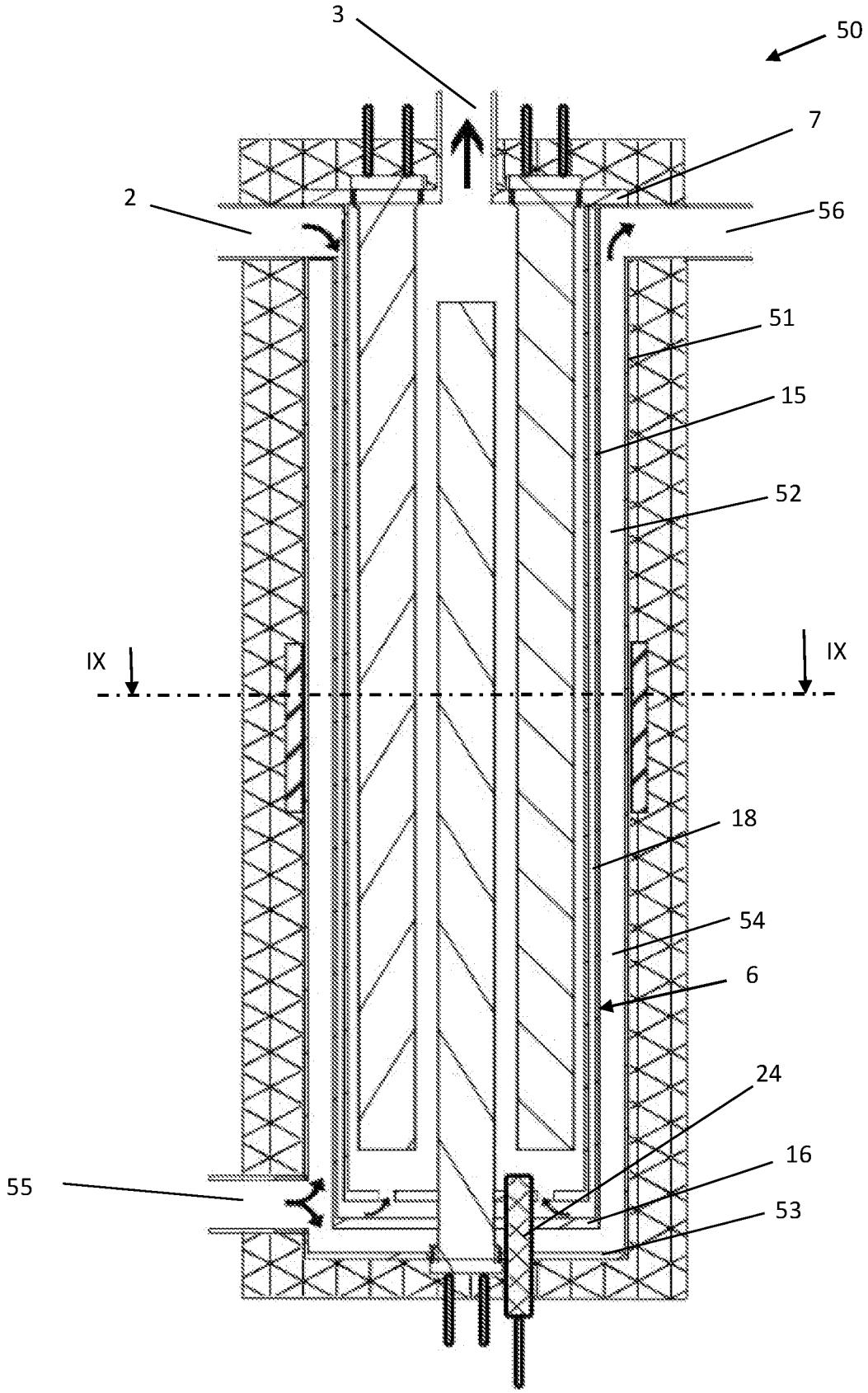
Figure 9:
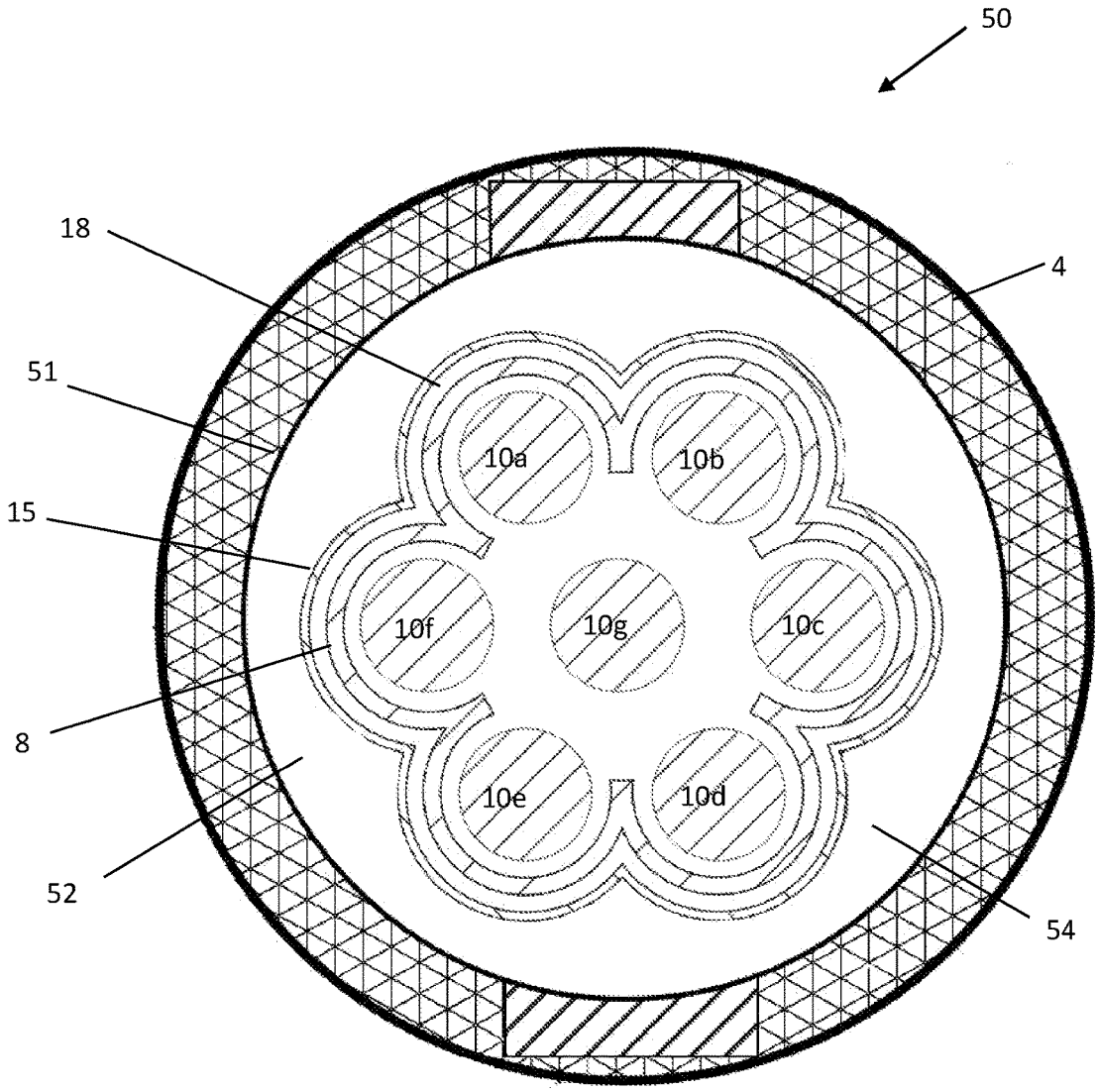
Figure 10:
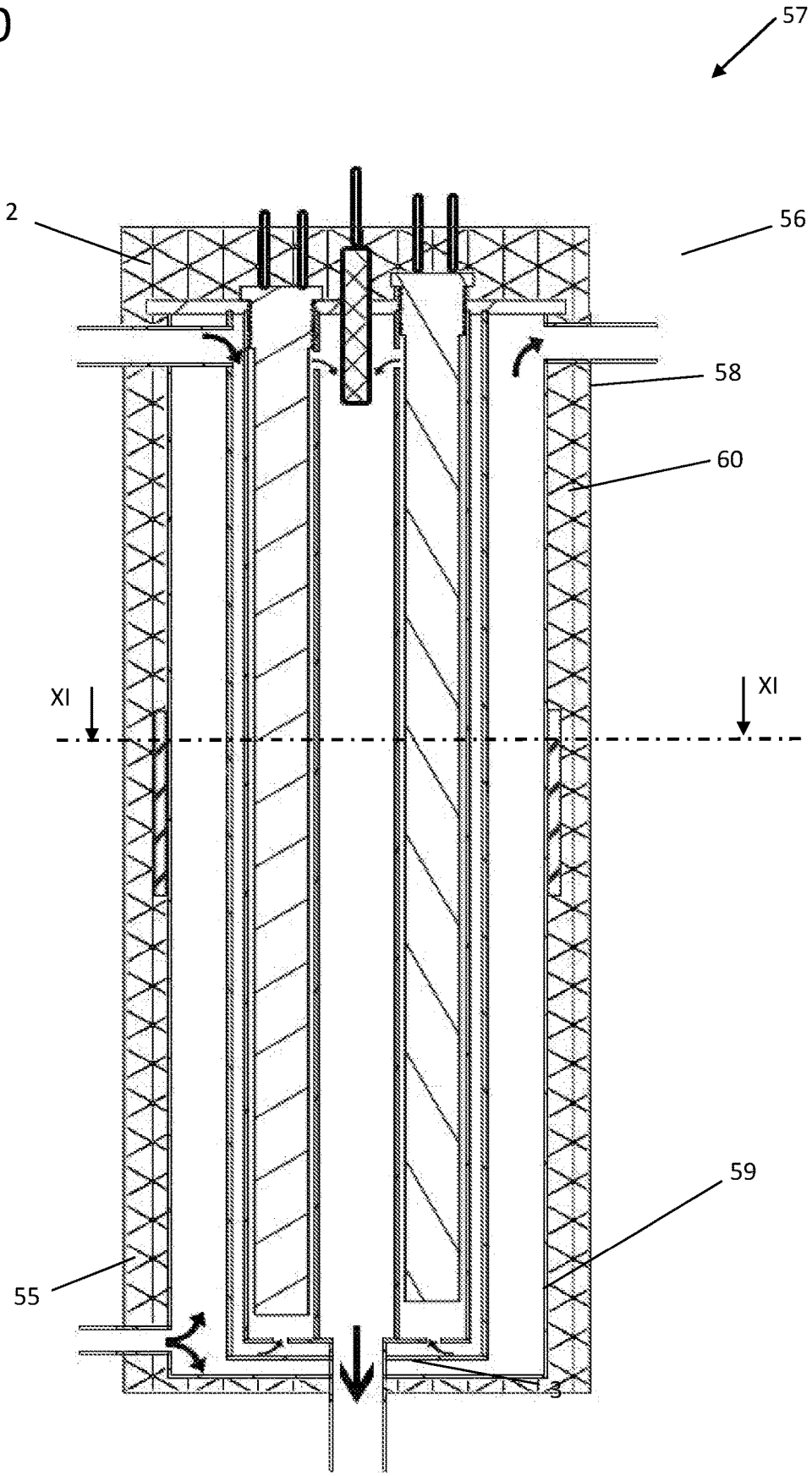
Figure 11:
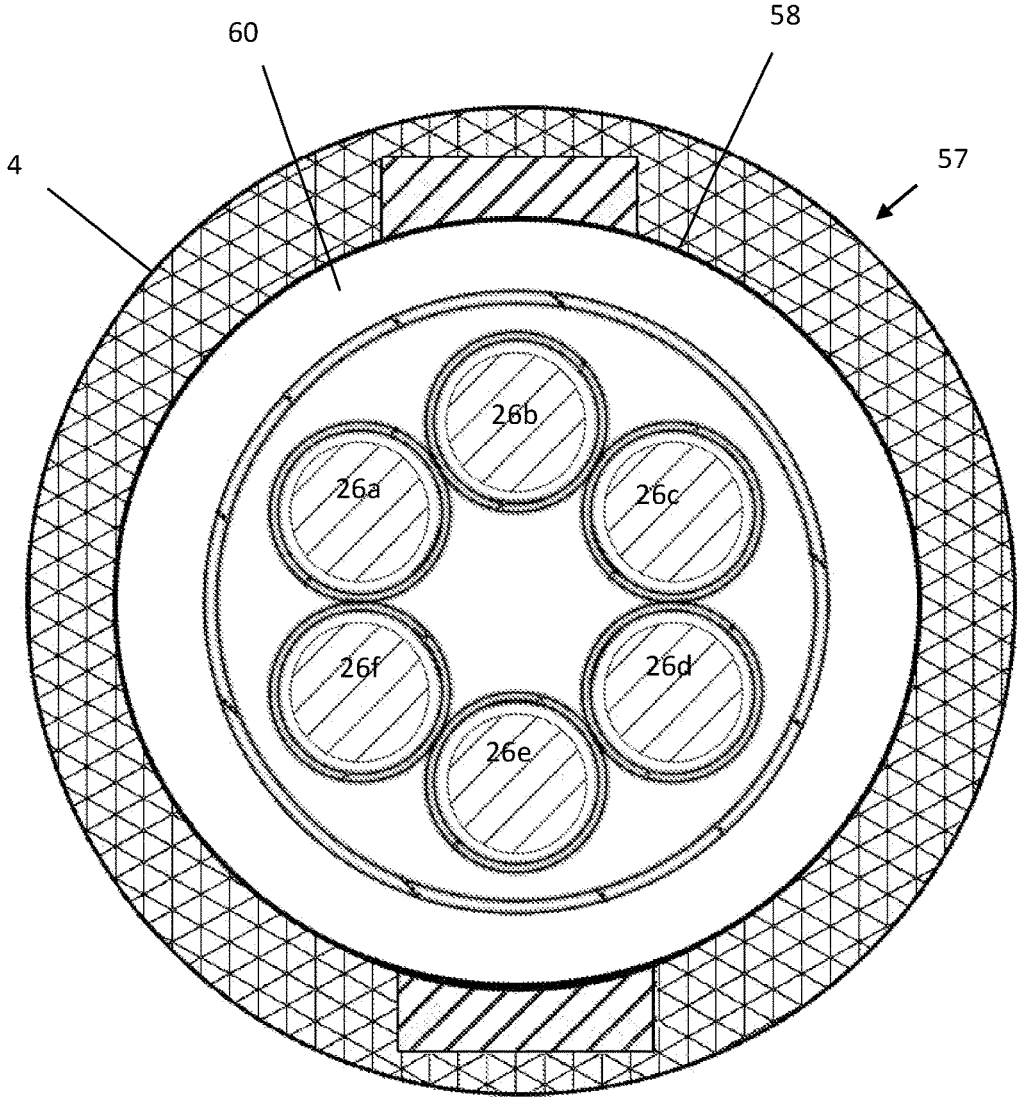
Figure 12:
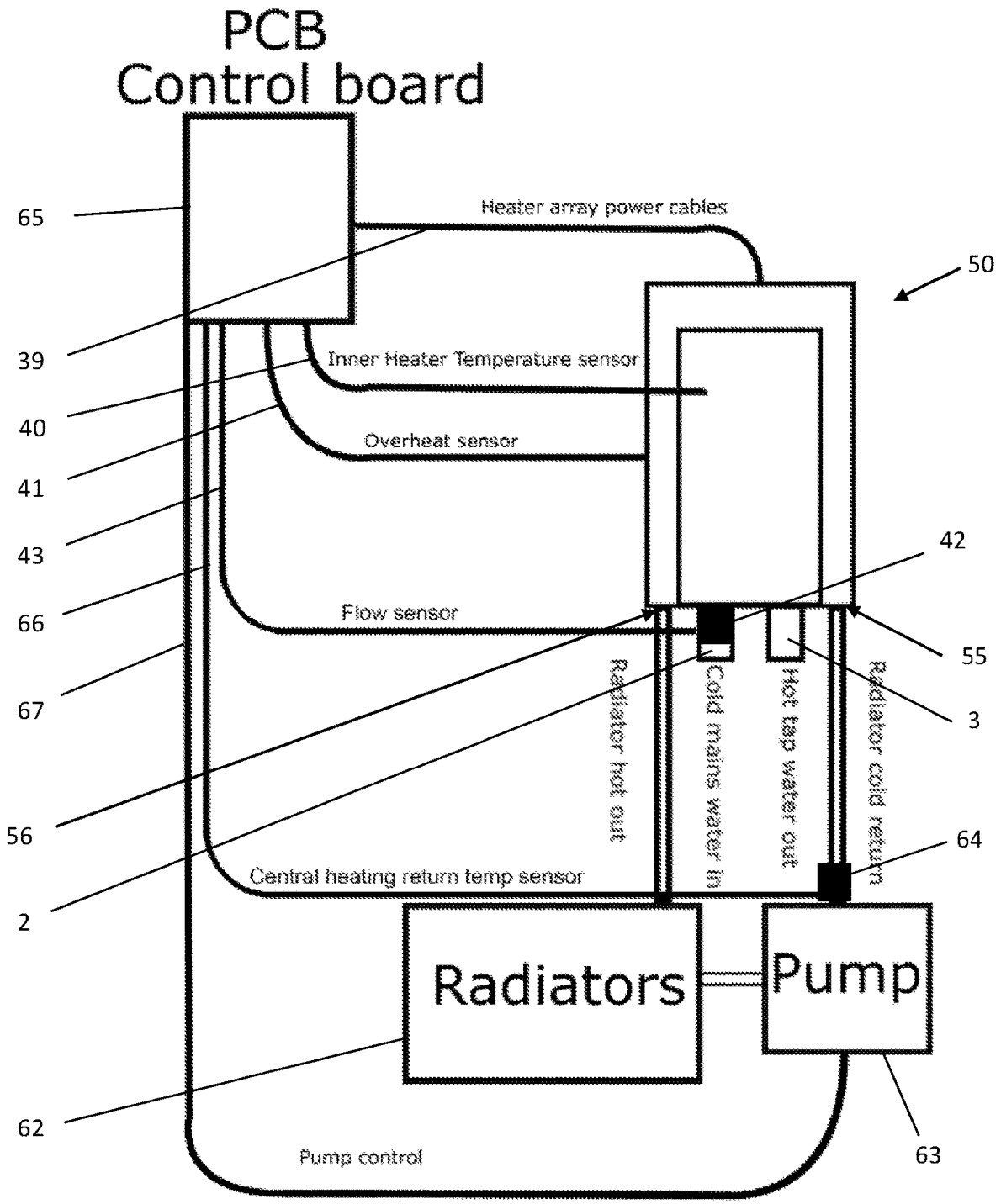
Figure 13:
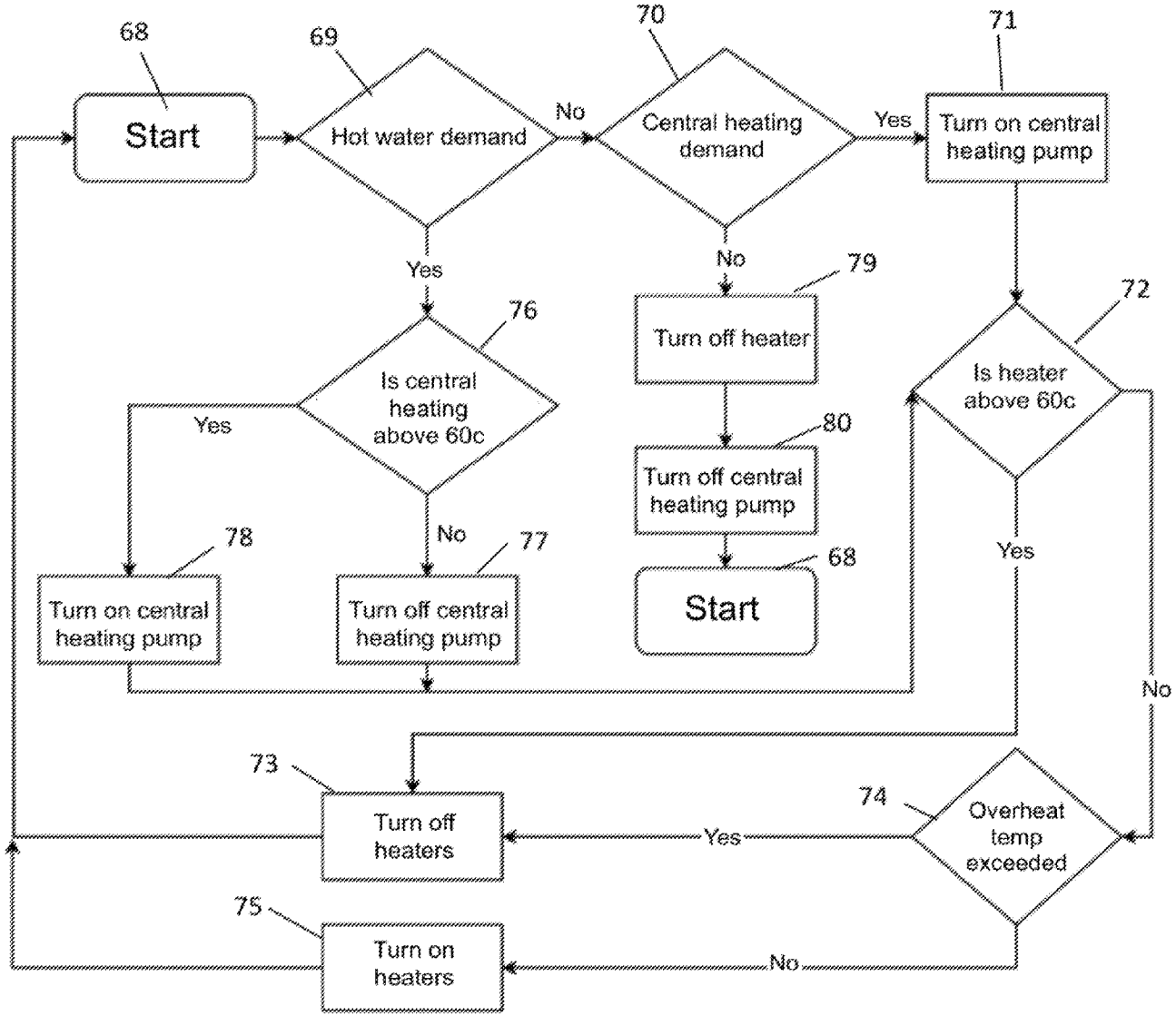

FIG. 6 schematically illustrates a control system for the boiler of either FIG. 2 or FIG. 4;

FIG. 7 is a flow chart representing the control logic of the control system of FIG. 6;

FIG. 8 is a vertical cross-section through a boiler in accordance with the present invention, similar to the boiler of FIGS. 2 and 4 but having an outer jacket for heating water of a central heating system;

FIG. 9 is a cross-section through the line IX-IX of FIG. 8;

FIG. 10 is a vertical cross-section through a boiler in accordance with the present invention, similar to the boiler of FIG. 8;

FIG. 11 is a cross-section along the line XI-XI of FIG. 10;

FIG. 12 schematically illustrates a control system for the boiler of either FIG. 8 or 10; and FIG. 13 is a flow chart representing the control logic of the control system of FIG. 12.

Figure 1:
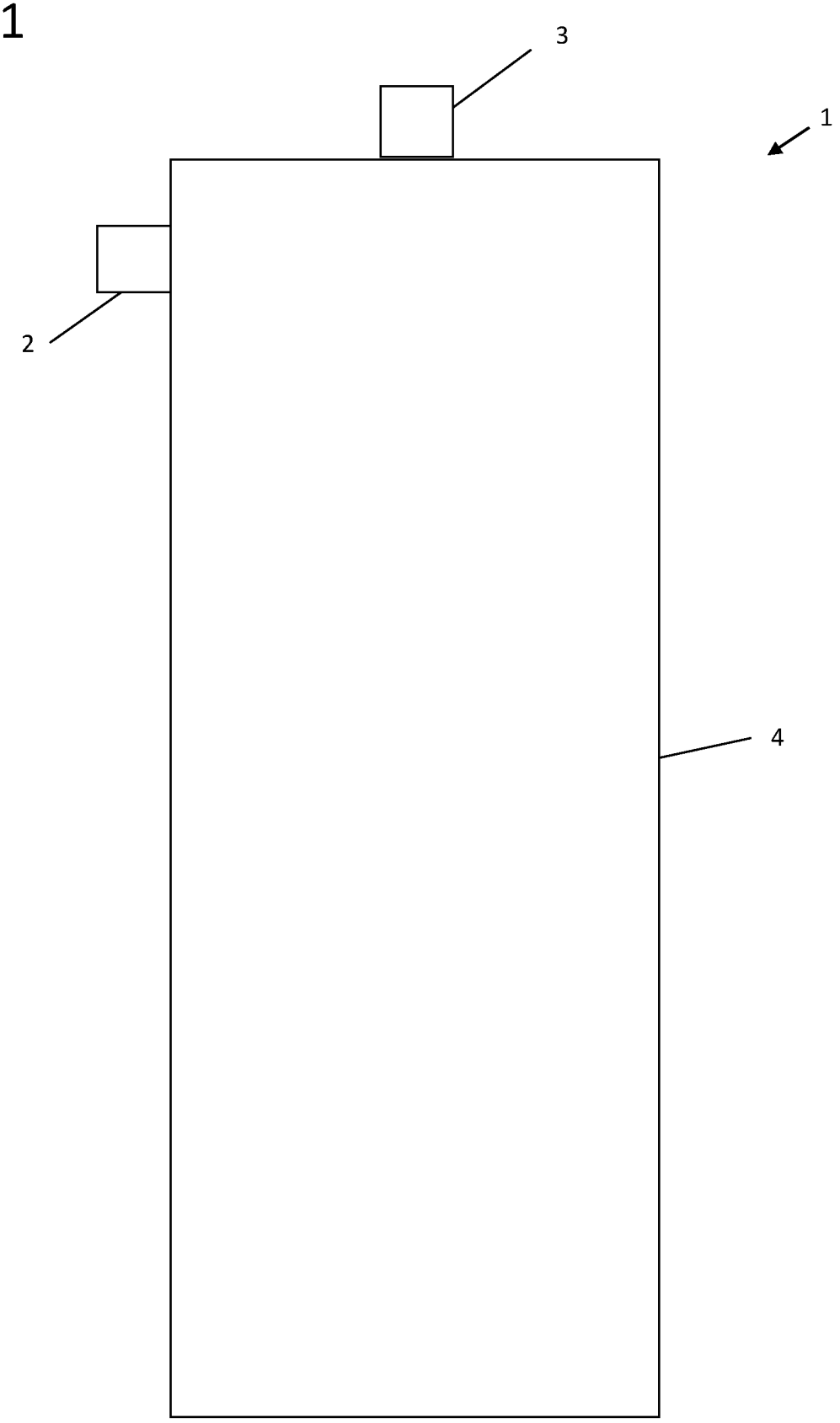
FIG. 1 is a side perspective view of a boiler in accordance with the present invention.

Referring to FIG. 1, this is a side elevation of a boiler in accordance with the present invention, indicated generally as 1, having a cold water inlet 2 and a hot water outlet 3 as indicated. The positions of the cold water inlet 2 and hot water outlet 3 correspond to the positions shown in the embodiment of the boiler illustrated in FIGS. 2 and 3. However the cold water inlet 2 and hot water outlet 3 could be at any convenient location, with appropriate pipework being provided within the outer casing 4 of the boiler 1. However, to minimise the dimensions of the overall casing the inlet 2 and outlet 3 may be located as shown, so that they directly connect into the main heating containers within the boiler 1, which will be described below with reference to the subsequent figures.

Although not shown, the boiler of FIG. 1 will also have an electrical connection for receiving electrical energy to heat water passing through the boiler and it may also have an appropriate control connection although, as will be described below, the boiler 1 may be controlled by a circuit which could be housed within the boiler casing 4.

Figure 3:
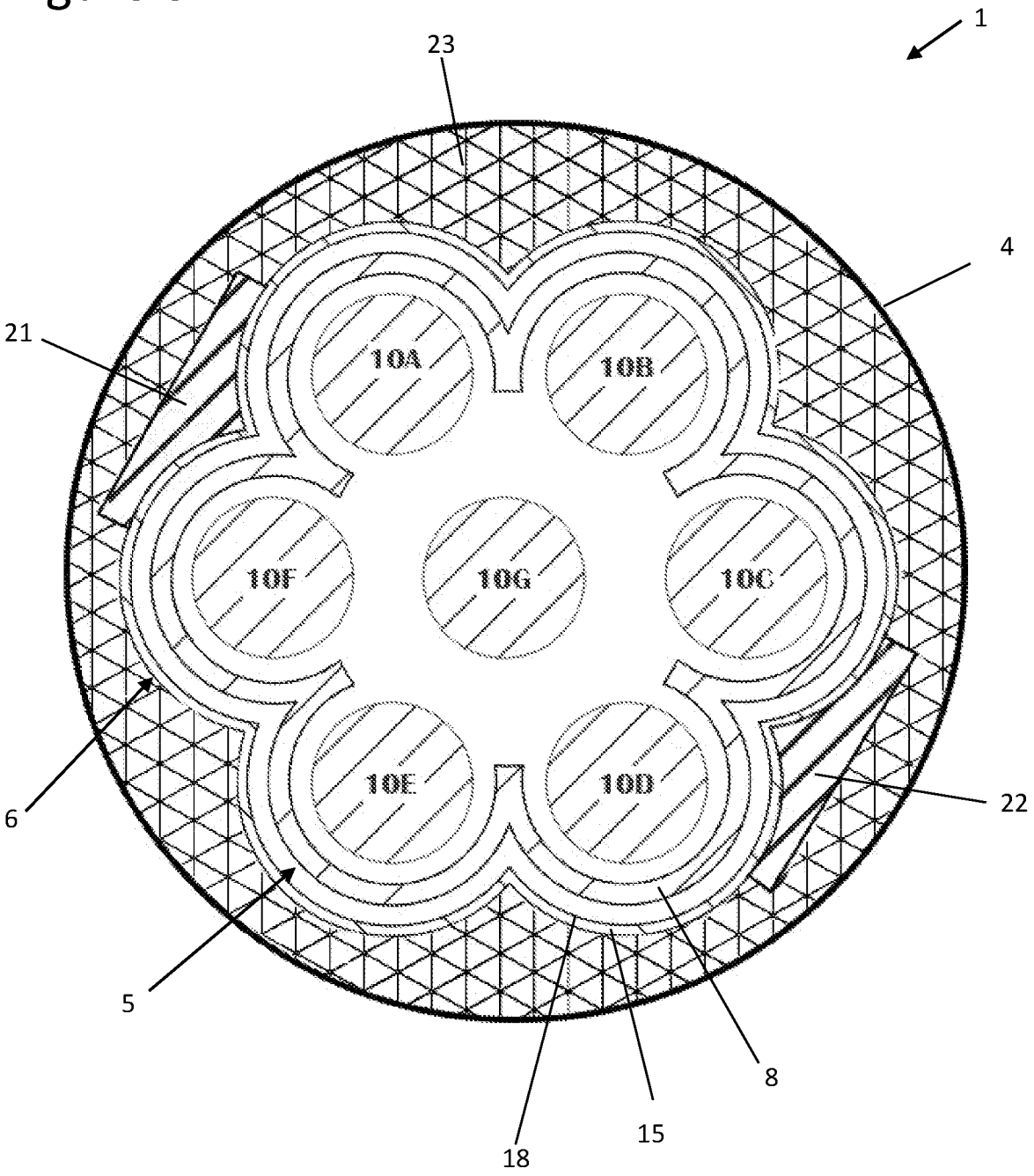
FIG. 3 is a cross-section through the line III-Ill of FIG. 2.

Referring now to the cross-section views of FIGS. 2 and 3, the boiler 1 comprises an inner container 5 and an outer container 6 which share a common first end plate 7. The inner container 5 also comprises a scalloped shaped inner cylinder 8, (which can be more clearly seen in FIG. 3), and an inner end plate 9. The inner container 5 contains seven two-kilowatt heating element cartridges 10*a* to 10*g*, shown in FIG. 3, with only the heating element cartridges 10*a*, 10*g* and 10*d* being visible in FIG. 2.

Each of the heating element cartridges 10*a* to 10*g* contains an internal electrical conductor and may additionally have a temperature sensing device, such as a thermistor, to control and limit the internal temperature of the heating element cartridge, but the temperature may be controlled in any one of a number of known ways.

The first end plate 7 has six threaded apertures into which respective ones of the heating element cartridges 10*a* to 10*f* are threaded and sealingly engaged. A further central aperture 11 in the first end plate 7 has a threaded port 12 extending therefrom to provide the hot water outlet 3.

With reference to FIG. 2, the inner end plate 9, at the opposite end of the inner cylinder 8 to the first endplate 7, has six apertures formed in it, only two of which, 13 and 14, can be seen in FIG. 2. These are positioned opposite to the distal ends of respective heating element cartridges 10*a* to 10*f*, to direct fluid passing into the inner container 5 over the respective heating element cartridges 10*a* to 10*f*. There is also a central aperture in the inner end plate 9, through which the heating element cartridge 10*g* passes.

External to the inner container 5 is the outer container 6. As previously mentioned, this shares the first end plate 7 with the inner container 5, but additionally comprises a scalloped shaped outer cylinder 15 and an outer end plate 16. The outer end plate 16 has a threaded central aperture 17 for the heating cartridge 10*g*.

The inner cylinder 8 and outer cylinder 15 define between their walls a small gap approximately 2 mm to 3 mm wide which defines a water jacket 18 about the inner cylinder 8. The separation between the inner end plate 9 and outer end plate 16 extends the water jacket 18 over the inner end plate 9. As can be seen from FIG. 2, the outer cylinder 15 has an aperture 19 in which is threaded a port 20, which forms the cold-water inlet 2.

On either side of the outer cylinder 15 there are located two ultrasonic transducers 21 and 22 housed within the outer casing 4 of the boiler 1, which outer casing 4 is filled with a thermally insulating material 23. The outer cylinder 15 is formed from copper tube having a wall thickness of between 1 mm to 2 mm. The inner cylinder 8 is formed of a similar thickness of copper and defining the water jacket 18 between them, which may be approximately 2 mm to 3 mm wide. When the heating element cartridges 10*a* to 10*g* are located within the inner cylinder 8 and the boiler is filled with water it will have a natural resonant frequency and the ultrasonic transducers 21 and 22 are tuned to approximately match this frequency, to maximise their effectiveness at preventing the build-up of scale and other deposits within the boiler 1. The boiler additionally comprises an over temperature sensor 24 which triggers should the temperature inside the boiler exceed a safe working threshold.

The cold water inlet 2, in the form of the threaded port 20, is directed tangentially to the walls of the inner and outer cylinders 8 and 15. Thus, in use, cold water entering the space between the outer cylinder 15 and inner cylinder 8 is directed circumferentially about the inner cylinder 8, so that it proceeds spirally as it is drawn downwards and through the apertures 13, 14 in the inner end plate 9. Then it travels through the inner cylinder 8, passing directly over the outer surfaces of the heating element cartridges 10*a* to 10*g*, before exiting the threaded port 12 to outlet 3. Thus, in use, when the heating element cartridges 10*a* to 10*g* are energised and water passing through the boiler 1 from the cold water inlet 2 to the hot water outlet 3, the water first passes around the outside of the inner container 5, preheating the water by absorbing heat from the inner container 5, prior to passing through apertures 13 and 14 into the inner container 5, where it is then heated, on a second pass, by directly coming into contact with the heating element cartridges 10*a* to 10*g*.

The double pass arrangement of the boiler 1 illustrated in FIGS. 1 to 3 provides a large heat transfer area for the limited volume of water contained within the boiler 1.

Figure 5:
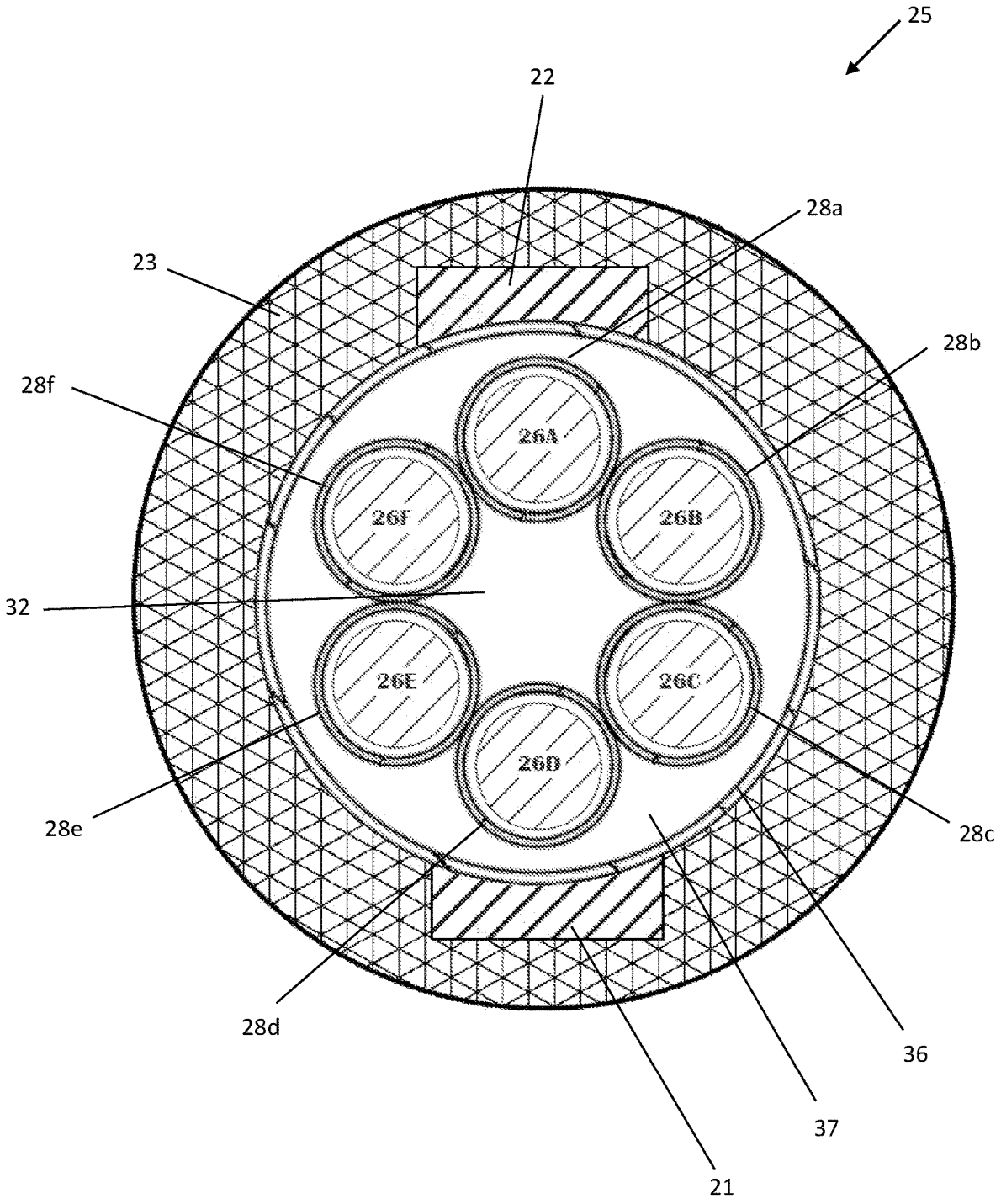
FIG. 5 is a cross-section along the line V-V of FIG. 4.

Referring now to FIGS. 4 and 5, here there is illustrated an alternative boiler to that shown in FIGS. 1 to 3 and this is indicated generally as 25. The boiler 25 has many of the same components as the boiler 1 of FIGS. 2 and 3 and like numerals are used to indicate like components, which are not described again here.

In the embodiment of FIGS. 4 and 5, six two kilowatt heating element cartridges 26*a* to 26*f* are arranged in a cylindrical pattern in a first end plate 27, with only the heating element cartridges 26*a* and 26*d* being visible in FIG. 4.

In this embodiment, each of the heating element cartridges 26*a* to 26*f* has a respective inner cylinder 28*a* to 28*f* joined at a first end to the first end plate 27 and joined at a second end to a common inner end plate 29. As in the previous embodiment, the inner end plate 29 has apertures, only two of which, 30 and 31, can be seen in FIG. 4, located opposite to the end of each heating element cartridge 26*a* to 26*f*.

Each of the inner cylinders 28*a* to 28*f* has an aperture, only two of which, 33 and 34, can be seen in FIG. 4, adjacent the first end plate 27. These connect the interior of each inner cylinder 28*a* to 28*f* with a central passage 32. The central passage 32 extends the length of the inner cylinders 28*a* to 28*f* and through the inner end plate 29 to a threaded port 35, which forms the hot water outlet 3. As can be seen from FIG. 5, the six inner cylinders 28*a* to 28*f* abut each other and these are welded together such that they form a continuous sealed surface to define the central passage 32. External to the inner cylinders 28*a* to 28*f* there is located an outer cylinder 36, which defines a space which, when filled with water, forms a water jacket 37.

In use, water enters the boiler 25 of FIGS. 4 and 5 through cold water inlet 2 and spirals downwardly within the water jacket 37, drawing heat energy from the outwardly facing outer surfaces of the inner cylinders 28*a* to 28*f*, before entering those inner cylinders 28*a* to 28*f*, via apertures such as apertures 30 and 31 shown in FIG. 4. The water is then forced to flow over the surfaces of the heating element cartridges 26*a* to 26*f* before exiting at apertures, such as apertures 33 and 34, into the central conduit 32. Here the water passes along the length of the central passage 32, in contact with the inwardly facing outer surfaces of the inner cylinders 28*a* to 28*f*, drawing heat energy from the inwardly facing outer surfaces of the inner cylinders 28*a* to 28*f*, as it makes a third pass through the boiler 25, before exiting the hot water outlet 3.

It will be appreciated that the same advantages are achieved with the boiler 25 of FIGS. 4 and 5 as are achieved with the boiler 1 of FIGS. 2 and 3, but with the boiler 25 of FIGS. 4 and 5 the water makes an additional third pass, resulting in an even more efficient heat exchange with the heating element cartridges 26*a* to 26*f*.

Referring now to FIG. 6, here there is schematically illustrated the various components necessary to control the boiler 1 of FIGS. 2 and 3, or the boiler 25 of 4 and 5. These comprise a processor (control circuit) 38 arranged to control the supply of electrical energy along cables 39 to the heating element cartridges 10*a* to 10*g*, or 26*a* to 26*f*. The processor 38 is also connected to temperature sensors of the inner heating elements 10*a* to 10*g*, or 26*a* to 26*f* by the wire 40.

The processor 38 is also connected to the over temperature sensor 24, via wire 41, and to an optional flow sensor 42, via wire 43. The flow sensor 42 is shown external to the boiler 1. However, it should be noted that FIG. 6 is only schematic and the flow sensor 42 and the processor 38 could be within the outer casing 4 of the boiler 1.

Referring now to FIG. 7, in use the processor 38, at the start 44, first determines in step 45, from the flow sensor 42, whether there is a demand for hot water. If there is no demand for hot water, the processor 38 returns to the start 44. However, in an alternative embodiment, where there is no flow sensor, the heating elements may be maintained at 60° C., in which case step 45 may be omitted. In the illustrated embodiment, if there is a demand for hot water, then the processor 38 proceeds to step 46 and determines whether the temperature within the heating element cartridges 10*a* to 10*g*, or 26*a* to 26*f*, is above 60° C. If this temperature is exceeded then the processor proceeds to step 47 and turns off the heating element cartridges 10*a* to 10*g*, or 26*a* to 26*f*, and returns to the start 44. However, if at step 46 the heating element temperature is not detected to be above 60° C., then the processor 38 proceeds to step 48 and determines whether an over temperature value is exceeded. If it is then the processor 38 proceeds to step 47 and turns off the heating element cartridges 10*a* to 10*g*, or 26*a* to 26*f*, before returning to the start 44. If however the over temperature value is not exceeded at step 48, then the processor 38 proceeds to step 49 and turns on the heating element cartridges 10*a* to 10*g*, or 26*a* to 26*f*, before returning to the start 44 and repeating the process.

The above describes one process in which the processor 38 may control energisation of the heating element cartridges 10*a* to 10*g*, or 26*a* to 26*f*, but it will be apparent that any number of other arrangements of steps may be possible to achieve the same overall result. Particularly it should be noted that the flow sensor 42 of FIG. 6 is not essential, for instead the boiler 1 could be maintained at a constant 60° C., regardless of whether water is flowing through the boiler or not, with the steps shown in FIG. 7 modified accordingly, by deleting step 45.

Referring now to FIGS. 8 and 9, here there is illustrated an embodiment of a boiler, indicated generally as 50, which is essentially a two pass boiler for providing hot water, similar to that disclosed and described previously with reference to FIGS. 2 and 3. The components common with FIGS. 2 and 3 are not described again here, as they function in the same manner. However, in the embodiments of FIGS. 8 and 9, a second outer cylinder 51 is positioned around the former outer cylinder 15, (in this embodiment hereinafter referred to as the first outer cylinder 15), to define a space 52 between the second outer cylinder 51 and the first outer cylinder 15. The second outer cylinder 51 is joined at a first end to the first end plate 7, which together with a second outer end plate 53 forms a second water jacket 54 about the outer container 6. The second water jacket 54 has a second inlet 55 at a first end and a second outlet 56 at a second end. This separate second water jacket 54 may be used to heat a separate body of water and this may typically form the boiler of a central heating system. Thus, in the embodiment of FIGS. 8 and 9 the boiler 1 may function as a combination boiler, heating separately sanitary hot water and the water of a central heating system, in a manner to be subsequently described.

Referring now to FIGS. 10 and 11, these show a boiler 57 which is a triple pass boiler similar to that previously described with reference to FIGS. 4 and 5. Similar to the embodiment previously described with reference to FIGS. 8 and 9 this also comprises an additional second outer cylinder 58 and a second outer end plate 59, forming a second water jacket 60, so that a boiler similar to the triple pass boiler of FIGS. 4 and 5 may also be used to provide sanitary hot water and also form the boiler for a central heating system.

Referring now to FIG. 12, here there is schematically illustrated the various components necessary to control the boiler 50 of FIGS. 8 and 9, or the boiler 57 of FIGS. 10 and 11. Some of these are similar to the components previously described with reference to FIG. 6 and comprise a processor 65 and a flow sensor 42, for determining when hot water is being drawn through the boiler 50 for a sanitary supply.

The boiler 50 of FIG. 12 additionally has the outlet 56 connected to a plurality of radiators 62, which in turn are connected to a pump 63. The pump 63 is also connected through a central heating return temperature sensor 64 to the inlet 55 of the boiler 50, to complete the return of the central heating circuit. The central heating return temperature sensor 64 sends a signal, dependent on the return temperature of water to the boiler 50, to the processor 65 along wire 66. The processor 65 also controls operation of the pump 63 via cable 67, but otherwise the connections between the processor 65 and boiler 50 are the same as the connections between the processor 38 and boiler 1 of FIG. 6.

Referring now to FIG. 13, this schematically illustrates the steps performed by the processor 65 of FIG. 12 during operation of either the boiler 50 of FIGS. 8 and 9, or the boiler 57 of FIGS. 10 and 11.

From the start 68, the processor 65 at step 69 determines whether or not there is a demand for hot water, by monitoring the signal from the flow sensor 42. If there is no demand for hot water, the processor 65 determines at step 70 whether there is a demand for central heating. This may be determined within the processor 65, where the processor 65 is part of a central heating controller. Alternatively, the processor 65 may receive a separate signal (not shown) indicating whether or not there is a demand for central heating.

If there is no demand for central heating at step 70 (and no demand for hot water) the processor 65 at step 79 turns off the central heating pump 63 and then turns off the heating element cartridges at step 80 before returning to the start 68. However, if there is a demand for central heating at step 70 (but no demand for hot water) the processor 65 at step 71 turns on the central heating pump 63.

The processor 65 then determines at step 72 if the temperature of the heating element cartridges 10*a* to 10*g* is above 60° C. If the temperature of the appropriate heating cartridges is above 60° C. then the processor 65 proceeds to step 73 and turns off the heating elements cartridges 10*a* to 10*g* before returning to the start 68.

Alternatively, if at step 72 the processor the temperature of the heating element cartridges 10*a* to 10*g* is below 60° C., the processor 65 then proceeds to step 74 and determines whether or not the over temperature threshold for the boiler is exceeded, as determined by the over temperature sensor 24. If the over temperature threshold is not exceeded at step 74, then the processor proceeds to step 75 and turns on the heating element before returning to the start 68. If the over temperature is exceeded at step 74, then the processor 65 proceeds to step 73 and turns off the heating elements and proceeds again to the start 68.

If at step 69 the processor determines that there is a demand for hot water the processor proceeds to step 76, to determine if the central heating return is above 50° C. If it is not above 50° C. the processor proceeds to step 77 and turns off the central heating pump before proceeding again to step 72.

Alternatively, if at step 76 the processor 63 determines that the central heating return is above 50° C. then the processor proceeds instead to step 78 and turns on the central heating pump, before proceeding to step 72.

The purpose of step 76, (the processor determining if the central heating return is above 50° C. or not), when there is a demand for hot water, is that if the central heating return is above 50° C. then the central heating pump 63 should be on because, with reference for example to FIG. 8, this will result in warm water being provided from the central heating system to the second water jacket 54, which will act to preheat the cold water of the sanitary supply as it enters the boiler at the cold water inlet. However, if the central heating return is below 50° C. then the processor 65 turns off the central heating pump 63 at step 77, ensuring that all the heat generated by the heating element cartridges, when these are turned on at step 75, is used to heat the sanitary water flowing through the boiler between the cold water inlet 2 and hot water outlet 3.

In the above manner, the water within the central heating circuit can be used as a residual store of energy, to be depleted when there is a demand for hot water, with the energy in the central heating system being replenished when there is no demand for hot water. This may permit a relatively low powered boiler to satisfactorily supply both the demand for instantaneous hot water, whilst also providing the energy source for a central heating system.

As an alternative embodiment to the embodiment described above with reference to FIGS. 12 and 13, the central heating return temperature sensor 64 of FIG. 12 could be omitted, it being assumed that the temperature of the central heating return will always be greater than the temperature of the cold water at the cold water inlet 2 and that some heat will always be transferred from the central heating return to sanitary water as it enters the boiler 50. With this arrangement the flow sensor 42 could also be omitted, with the heating element cartridges being controlled to permanently maintain them at 60° C. Here steps 69, 76, 77, 78 and 80 of FIG. 13 would be omitted, with the processor 65 proceeding directly from step 79 to step 72.

Various embodiments of the present invention have been described above by way of example only and many alternative embodiments are possible which fall within the scope of the following claims.

The invention claimed is:

1. An electric boiler comprising a plurality of heating element cartridges that are each substantially cylindrical in one or more inner containers that are each thermally conductive, at least one inner container surrounding one or more heating element cartridges of the plurality of heating element cartridges to define an inner passage about the one or more heating element cartridges, the at least one inner container having an inlet and an outlet for a flow of water and being arranged such as to cause water received at the inner container inlet to flow along the inner passage, in close proximity to a surface of the one or more heating element cartridges to the inner container outlet, the electric boiler further comprising an outer container in which the at least one inner container is substantially located, the outer container defining an outer passage extending around at least part of the at least one inner container, the outer container having an inlet and at least one outlet for a flow of water, wherein the at least one outer container outlet is connected to, or forms, at least one inner container inlet, wherein the outer container is arranged such as to cause water received at the outer container inlet to flow along the outer passage in close proximity to a surface of the at least one inner container to the at least one outer container outlet, and wherein the at least one inner container is shaped to have an inner surface that at least in part follows the profile of an outer surface of at least one heating element cartridge, to define at least one partly confined portion of the inner passage for water to flow between the at least one inner container and the at least one heating element cartridge, wherein the plurality of heating element cartridges are arranged in a cylindrical pattern with the outer surface of the one or more inner containers defining a continuous inner wall of the outer container.

2. An electric boiler as claimed in claim 1, wherein the inner and outer passages are arranged such that, in use, water in the outer passage progresses along the outer passage in a direction opposite to the direction in which water progresses along the inner passage.

3. An electric boiler as claimed claim 1, wherein the one or more inner containers consists of a single inner container in which the plurality of heating element cartridges is located.

4. An electric boiler as claimed in claim 1, wherein the plurality of heating element cartridges comprises a plurality of elongate heating element cartridges, the at least one inner container comprises a plurality of tubular inner containers, and each elongate heating element of the plurality of elongate heating elements is arranged concentrically within an associated tubular inner container of the plurality of tubular inner containers.

5. An electric boiler as claimed in claim 4, wherein the plurality of tubular inner containers are arranged side by side in a cylindrical pattern and connected to each other to define a central passage within the electric boiler, whereby the tubular inner containers are aligned with a longitudinal axis of the electric boiler and wherein the electric boiler is arranged such that water enters through the at least one outer container at or towards a first end of the electric boiler and travels in a first longitudinal direction along the outer passage to exit the outer passage through the at least one outer container outlet at or towards a second end of the electric boiler opposite to the first end, to enter the tubular inner containers through respective inner container inlets located at or towards a second end of the electric boiler, the water then passing along the respective inner passages to exit via respective outlets of the tubular inner containers, located at or towards the first end of the electric boiler, to enter the central passage and pass along the central passage towards the second end of the electric boiler.

6. An electric boiler as claimed in claim 4, wherein the at least one outer container comprises at least two end portions and a cylindrical portion extending therebetween in which the plurality of tubular inner containers are located, wherein each heating element cartridge is secured in place in one of the two end portions.

7. An electric boiler as claimed in claim 1, wherein the outer container inlet is arranged to direct water tangentially into the outer passage so that the water spirals around the at least one inner container as the water progresses along the outer passage to the at least one outer container outlet.

8. An electric boiler as claimed in claim 1, further comprising one or more ultrasonic transducers arranged to dislodge or breakdown any scale or similar accumulations of solid material from within the electric boiler.

9. An electric boiler as claimed in claim 1, wherein the outer container is a first outer container, the electric boiler further comprising a second outer container in which the first outer container is located, wherein the first outer container and second outer container share a common thermally conductive wall, the second outer container having an inlet and an outlet and defining a second outer container passage arranged to convey water in close proximity to the common thermally conductive wall from the inlet to the outlet of the second outer container, and wherein the passage of the second outer container is in fluid isolation from both the passage of the first outer container and the passage of the at least one inner container.

10. A central heating and hot water system comprising an electric boiler as claimed in claim 9, the electric boiler further comprising a first inlet connected to a sanitary water supply and a first outlet arranged to supply sanitary water heated once by the electric boiler, the electric boiler further comprising a second inlet connected to a central heating return and a second outlet, wherein the electric boiler is configured such that sanitary water to be heated enters through the first inlet of the electric boiler, before being received by and passing through the first outer container passage and at least one inner container passage before and then exiting the electric boiler through the first outlet of the electric boiler, and such that water from the central heating system to be heated enters through the second inlet of the boiler and passing through the passage of the second outer container, before then exiting the electric boiler through the second outlet of the electric boiler to be recirculated around the central heating system.

11. A central heating system as claimed in claim 10, further comprising a pump for circulating water around the central heating system, a temperature sensor for detecting the temperature of water returning to the electric boiler through the second inlet, a flow or pressure sensor for detecting the flow of sanitary water through the electric boiler and a controller arranged to control the pump at least in part in dependence on signals received from the temperature sensor and the flow or pressure sensor, wherein the pump is activated if it is detected that sanitary water is being drawn through the electric boiler and that the temperature of the central heating water returning to the electric boiler is above a predetermined temperature and wherein the pump is deactivated if the temperature of the water returning to the electric boiler from the central heating system is below a predetermined temperature.

12. An electric boiler comprising:

a plurality of elongate heating element cartridges that are each substantially cylindrical;

a plurality of tubular inner containers surrounding the plurality of elongate heating element cartridges, with each elongate heating element cartridge of the a plurality of elongate heating element cartridges being arranged concentrically within an associated tubular inner container of the plurality of tubular inner containers to define an inner passage about the heating element cartridge, each tubular inner container being thermally conductive, having an inlet and an outlet for a flow of water, and being arranged such as to cause water received at the inner container inlet to flow along the inner passage, in close proximity to a surface of the concentrically arranged elongate heating element cartridge to the inner container outlet; and an outer container in which the plurality of tubular inner containers is substantially located, the outer container defining an outer passage extending around at least part of each tubular inner container, the outer container having an inlet and at least one outlet for a flow of water;

wherein the at least one outer container outlet is connected to, or forms, at least one inner container inlet; and wherein the outer container is arranged such as to cause water received at the outer container inlet to flow along the outer passage in close proximity to surfaces of the tubular inner containers to the at least one outer container outlet.

13. An electric boiler as claimed in claim 12, wherein the plurality of tubular inner containers are arranged side by side in a cylindrical pattern and connected to each other to define a central passage within the electric boiler, whereby the tubular inner containers are aligned with a longitudinal axis of the electric boiler and wherein the electric boiler is arranged such that water enters through the at least one outer container at or towards a first end of the electric boiler and travels in a first longitudinal direction along the outer passage to exit the outer passage through the at least one outer container outlet at or towards a second end of the electric boiler opposite to the first end, to enter the tubular inner containers through respective inner container inlets located at or towards a second end of the electric boiler, the water then passing along the respective inner passages to exit via respective outlets of the tubular inner containers, located at or towards the first end of the electric boiler, to enter the central passage and pass along the central passage towards the second end of the electric boiler.

* * * * *